US008317559B2

(12) United States Patent
Butler

(10) Patent No.: US 8,317,559 B2
(45) Date of Patent: Nov. 27, 2012

(54) ERGONOMIC HAND GRIPS FOR WATERCRAFT

(75) Inventor: Lee W. Butler, Portland, OR (US)

(73) Assignee: Lee W. Butler, Portland, OR (US)

( * ) Notice: Subject to any disclaimer, the term of this patent is extended or adjusted under 35 U.S.C. 154(b) by 829 days.

(21) Appl. No.: 12/290,378

(22) Filed: Oct. 29, 2008

(65) Prior Publication Data

US 2009/0111340 A1 Apr. 30, 2009

(51) Int. Cl.
*B63B 35/79* (2006.01)

(52) U.S. Cl. ..... 441/65; 441/74

(58) Field of Classification Search ..... 441/65, 441/68, 70, 74; D21/769, 770
See application file for complete search history.

(56) References Cited

U.S. PATENT DOCUMENTS

| | | | | | |
|---|---|---|---|---|---|
| 2,613,456 | A * | 10/1952 | Amico | ..... | 36/180 |
| 2,791,844 | A * | 5/1957 | Horlacher | ..... | 36/153 |
| 5,779,510 | A * | 7/1998 | Skedelski | ..... | 441/75 |
| 5,910,035 | A * | 6/1999 | Rebotier et al. | ..... | 441/74 |
| 6,007,394 | A * | 12/1999 | Kagan | ..... | 441/74 |
| 7,675,505 | B1 * | 3/2010 | Gehrking | ..... | 345/163 |

* cited by examiner

*Primary Examiner* — Ajay Vasudeva
(74) *Attorney, Agent, or Firm* — Nathan Koenig

(57) ABSTRACT

The invention comprises a non-slip foam pad that provides an ergonomically shaped grip for the hands for use on a personal water craft surface, such as a surfboard or body board, to provide for maximum grip during maneuvers which involve moving through oncoming water while maintaining a grip on said watercraft.

10 Claims, 3 Drawing Sheets

ERGONOMIC HAND GRIPS FOR WATERCRAFT

FIELD OF THE INVENTION

This invention relates generally accessories for personal watercraft that provide greater user control over the device, and more particularly to gripping surfaces that can be applied to a surfboard to facilitate paddling through oncoming waves.

BACKGROUND

A number of recreational pursuit employ personal watercraft that ride, plane or glide over varying water surfaces. Perhaps the most widely known and widely practiced of these pursuits is surfing, wherein a user maneuvers a surfboard onto the face of a breaking wave and attempts to balance on and control the board while being carried along with the wave. As can be appreciated, it is critical that the user have adequate friction to engage the board and have sufficient control to perform as desired.

Historically, friction between a user's feet and the surfboard has been increased by applying wax to the surface of the board. Although useful and still commonly used, using wax to increase traction involves a number of drawbacks. The process of applying the wax is time consuming and must be repeated whenever the wax melts or rubs off. Further, the sticky nature of the wax makes it extremely susceptible to contamination by sand. This requires the user to exercise considerable care to avoid contacting the surfboard surface with sand and the laborious removal of the wax and reapplication when sand inevitably gets stuck in the wax.

To overcome some of the deficiencies of wax, various configurations of foam traction pads have been used to provide engagement for the user's feet. In general, such pads have been popular and their use has spread to many sports that require a user to stand on a personal watercraft.

However, the prior art has offered very few methods for improving control of a personal watercraft when the user is not guiding the board with the user's feet or otherwise riding the board in its primary mode. For example, the prior art traction pads discussed above improve friction between the user's feet and the board when the user is riding the board on the face of the wave. Yet, when the user is lying on the board and paddling to get in position to catch a wave, the traction pads offer little or no help.

Accordingly, what has been needed is a device that improves a user's control over the personal watercraft. Similarly, there is a need for device that engages with a user's hand to provide such improved control. This invention satisfies these and other needs.

SUMMARY OF THE INVENTION

The invention comprises a non slip foam pad that provides an ergonomically shaped grip for the hands for use on a personal water craft surface, such as a surfboard or body board, to provide for maximum grip during maneuvers which involve moving through oncoming water while maintaining a grip on said watercraft.

In one embodiment, the invention is a grip for improving control over a personal watercraft, comprising a sheet of material and a wedge of increased thickness positioned within a perimeter defined by the sheet, wherein the sheet is sized to correspond to a user's palm, index finger and thumb of a user's hand and wherein the wedge is configured to engage between the user's index finger and thumb when the user's hand is positioned on the grip. Preferably, the sheet has a textured surface. Also, the sheet can be formed from a resilient material, such as foam. In the noted embodiment, the grip also includes a pressure sensitive adhesive applied to an underside to allow the grip to be affixed to the personal watercraft. In a further embodiment, the sheet of material has a relatively broad back end tapering to a relatively narrow front end.

Another aspect of the invention, in combination with a personal watercraft having a generally planar board configuration, is an ergonomic grip, the grip comprising a sheet of material and a wedge of increased thickness positioned within a perimeter defined by the sheet, wherein the sheet is sized to correspond to a user's palm, index finger and thumb of a user's hand, wherein the wedge is sized to engage between the user's index finger and thumb when the user's hand is positioned on the grip, and wherein the grip is affixed to the watercraft.

Yet another aspect of the invention is a method for improving control over a personal watercraft comprising the steps of providing a personal watercraft having a generally planar board configuration, providing a grip comprising a sheet of material and a wedge of increased thickness positioned within a perimeter defined by the sheet, wherein the sheet is sized to correspond to a user's palm, index finger and thumb of a user's hand, wherein the wedge is sized to engage between the user's index finger and thumb when the user's hand is positioned on the grip, affixing the grip to the watercraft and controlling the watercraft by grasping the grip.

BRIEF DESCRIPTION OF THE DRAWINGS

The present invention will be readily understood by the following detailed description in conjunction with the accompanying drawings, wherein like reference numerals designate like structural elements, and in which.

DETAILED DESCRIPTION OF THE INVENTION

A detailed description of one or more embodiments of the invention is provided below along with accompanying figures that illustrate the principles of the invention. While the invention is described in conjunction with such embodiment(s), it should be understood that the invention is not limited to any one embodiment. On the contrary, the scope of the invention is limited only by the claims and the invention encompasses numerous alternatives, modifications, and equivalents. For the purpose of example, numerous specific details are set forth in the following description in order to provide a thorough understanding of the present invention. These details are provided for the purpose of example, and the present invention may be practiced according to the claims without some or all of these specific details. For the purpose of clarity, technical material that is known in the technical fields related to the invention has not been described in detail so that the present invention is not unnecessarily obscured.

In one embodiment, the ergonomic grip pad design is a thin flexible foam top layer whose surface may be additionally textured to generate increase friction with a user's hand to provide for maximum traction. Positioned within the perimeter of the foam pad, approximately in the center, is a raised foam wedge designed to fit comfortably in the pit at the base of the thumb and index finger while the user is gripping the watercraft. The bottom layer of the ergonomic grip design preferably has a removable protective layer over a pressure-sensitive adhesive that allows the ergonomic grips to be attached to the watercraft.

Figure 1:
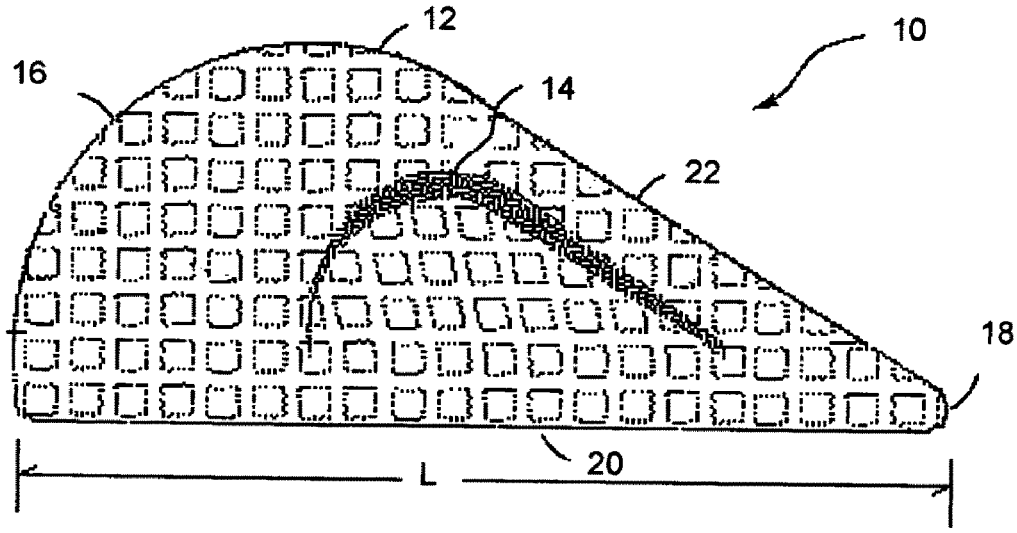
FIG. 1 illustrates a top perspective view of a grip having features of the invention.

Further details of the invention are shown in the Figures. Turning to FIG. 1, a hand grip 10 of the invention is shown in a top view a generally comprises a relatively thin sheet 12 of resilient material having a surface area substantially corresponding to a user's palm, index finger and thumb. A wedge 14 is configured to fit between the pit of a user's thumb and index finger when the user's hand is closed around grip 10. One end 16 of sheet 12 is relatively broad and sized to accommodate a user's palm. Preferably, the other end 18 tapers around wedge 14, and defines a region 20 for the user's thumb and another region 22 for the user's index finger. Preferably, the length L of sheet 12 from end 16 to end 18 is in the range of approximately 4 to 6 in. (10.2 to 15.2 cm), and more preferably, approximately 5 in (12.7 cm). Alternatively, length L should be the approximate length of a user's hand from wrist to index finger tip.

Generally, sheet 12 is formed from any suitable flexible foam material, such as olefinic material, urethane material, vinylchloride material, polyethylene material, cross-linked polyethylene materials and the like. Preferably, the foam material has a foam density configured to provide resilience under a user's hand force to increase engagement of the user's hand with the grip 10. For example, suitable foam densities are in the range of approximately 2 pcf to 12 pcf or more, and more preferably in the range of approximately 4 to 8 pcf. Generally, the foam material may also vary in thickness and be in the range of approximately 0.125 to 0.75 in. (3.2 to 19 mm), and preferably in the range of approximately 0.25 to 0.625 in. (6.3 to 16 mm) in thickness. In one embodiment, sheet 12 is formed from EVA foam.

Figure 2:
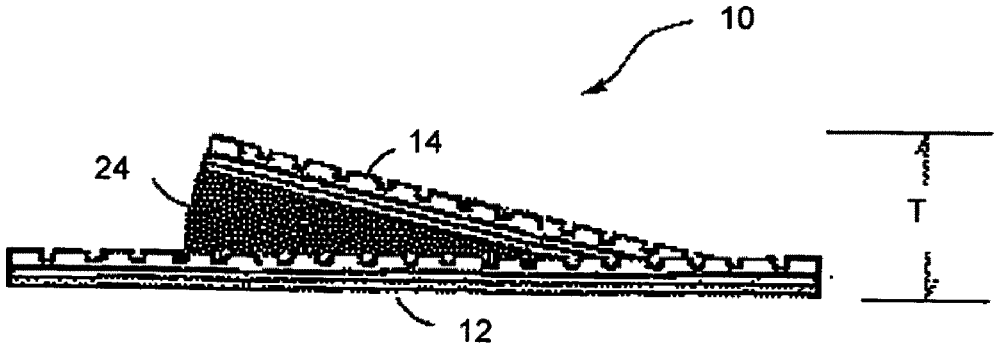
FIG. 2 illustrates a side view of a grip, according to the invention.

As shown in FIG. 2, wedge 14 can be formed by cutting a corresponding profile in sheet 12 and positioning foam insert 24 underneath sheet 12. Alternatively, any other suitable construction technique to form wedge 14 can be used. For example, sheet 12 can comprise a multi layered material and foam insert 14 can be laminated between the layers, without cutting a relief in sheet 12 or insert 24 can simply be positioned between sheet 12 and the personal watercraft. Preferably, the thickness T of wedge 14 is in the range of approximately 0.5 to 1.5 in. (13 to 38 mm), and more preferably approximately 1 in. (25 mm). Alternatively, thickness T should be slightly thicker than the depth of a user's hand from the palm to the back of the hand.

Preferably, the underside of sheet 12, and if appropriate, foam insert 24, has a pressure-sensitive adhesive to facilitate attachment of grip 10 to a personal watercraft. Even more preferably, a removable sheet (not shown) protects the adhesive, allowing a user to peel off the sheet to expose the adhesive prior to application.

Figure 3:
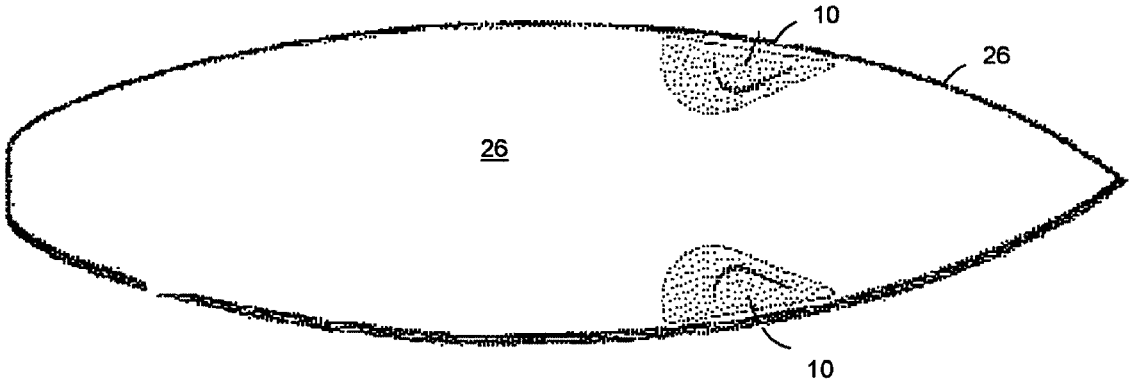
FIG. 3 illustrates placement of grip on a surfboard, according to the invention.
Figure 4:
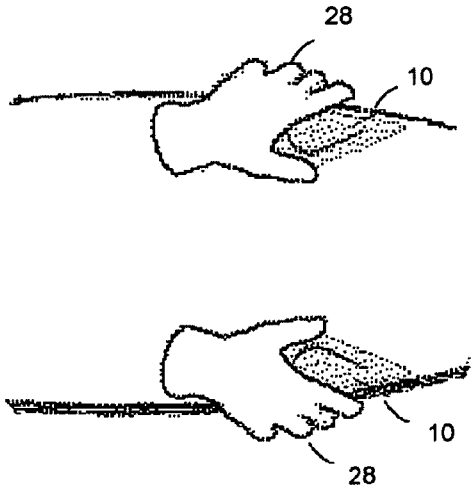
FIG. 4 shows a detail view of a user's hands in position on the grips, according to the invention.
Figure 5:
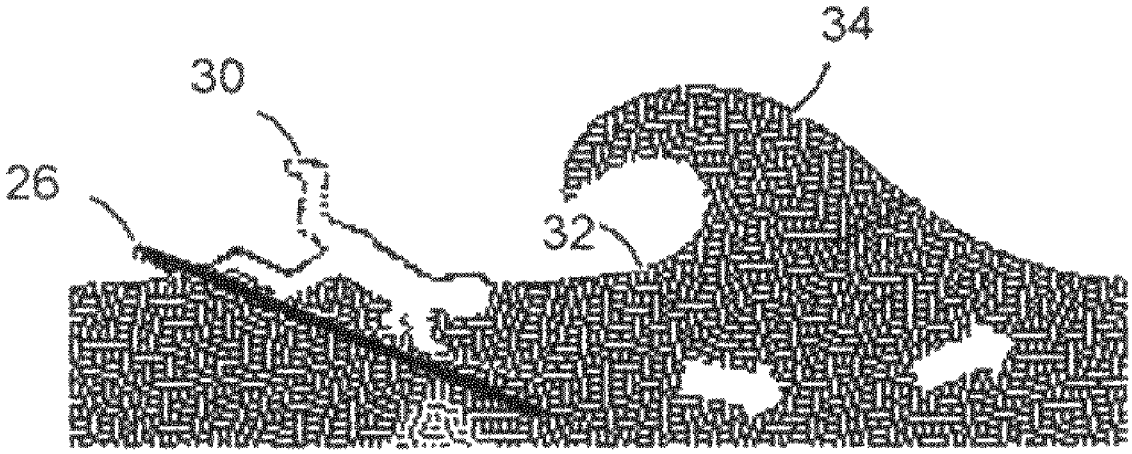
FIG. 5 is a graphical representation of a user employing a surfboard with grips to perform a duck dive, according to the invention.

FIG. 3 shows an exemplary personal watercraft in the form of surfboard 26. As can be seen, two grips 10 are affixed to surfboard 26 towards the front of the board. Grips 10 are handed so that the appropriate configuration can be used for the user's right and left hands. Generally, grips 10 should be positioned approximately even with a user's shoulders when the user is lying on surfboard 26 in a paddling position. FIG. 4 shows a detail view of user's hands 28 in position on grips 10.

As discussed above, ergonomic grips 10 provide a user with increased control over surfboard 26 when gripped. In one noted example, grips 10 facilitate a common surfing maneuver known as a "duck-dive" which involves moving through an oncoming mass of water while maintaining a grip on the watercraft. One having skill in the art will appreciate that the force of the oncoming wave will tend to push surfboard 26 backwards, causing wedge 14 of grip 10 engage securely into the base of the thumb and forefinger of a user's hand 28. FIG. 4 graphically depicts such a duck dive, in which a user 30 forces the surfboard 26 underneath surface of water 32, allowing the user to substantially avoid wave 34.

All references cited herein are intended to be incorporated by reference. Although the present invention has been described above in terms of specific embodiments, it is anticipated that alterations and modifications to this invention will no doubt become apparent to those skilled in the art and may be practiced within the scope and equivalents of the appended claims. For example, the use of a foam material can be substituted for a soft rubber or plastic and the general shape of the pad may be modified into a circular, elongated, or die cut decorative pattern. Similarly, a preferred embodiment has been described with respect to the sport of surfing, however the invention may be practiced with any suitable recreational activity that requires a user to control a personal watercraft with hands, such as boogie boarding, kneeboarding, and the like.

The present embodiments are to be considered as illustrative and not restrictive, and the invention is not to be limited to the details given herein. It is therefore intended that the disclosure and following claims be interpreted as covering all such alterations and modifications as fall within the true spirit and scope of the invention.

What is claimed is:

1. A pair of elongate grips attached to an upper planar surface of a water sports board for improving control over the board, each elongate grip comprising:

a sheet material defining a perimeter, the sheet material having a front end, a rear end, and inner and outer lateral edges extending between the front end and the rear end, the sheet material having a tapered shape with front end being substantially pointed and the rear end being curved and substantially broader than the front end; and a wedge of increased thickness positioned within the perimeter defined by the sheet, said thickness increasing in a lateral direction from the outer lateral edge toward the inner lateral edge, the wedge further comprising upper and lower surfaces, wherein the upper and lower surfaces diverge in the lateral direction from the outer lateral edge to the inner lateral edge; wherein the sheet is sized to correspond to a user's palm, index finger and thumb of a user's hand and wherein the wedge is configured to engage between the user's index finger and thumb when the user's hand is positioned on the grip.

2. The grips of claim 1, wherein the sheet has a textured surface.

3. The grips of claim 1, wherein the sheet is formed from a resilient material.

4. The grips of claim 3, wherein the resilient material is foam.

5. The grips of claim 1, further comprising a pressure sensitive adhesive applied to the lower surface to allow the grip to be affixed to the water sports board.

6. The grips of claim 1, wherein the grip has an overall length in the range of approximately 4 to 6 in. or 10.2 to 15.2 cm.

7. The grips of claim 1, wherein the grip has a thickness in the range of approximately 0.5 to 1.5 in. or 13 to 38 mm.

8. The grips of claim 1, wherein the grips are attached adjacent opposing lateral edges on the upper planar surface of the water sports board.

9. The grips of claim 1, wherein the water sports board is a surfboard.

10. A method of using the pair of elongate grips of claim 1 for improving control over a water sports board, comprising the steps of:

providing a water sports board having a generally planar board configuration, providing the elongate grips of claim 1, affixing the pair of grips to an upper planar surface of the water sports board, and controlling the watercraft by grasping the grip.

* * * * *